US010222089B2

(12) United States Patent
Chappell et al.

(10) Patent No.: US 10,222,089 B2
(45) Date of Patent: Mar. 5, 2019

(54) DAMPER WITH INTEGRATED BLADE STOP

(71) Applicant: T.A. Morrison & Company, Inc., Stittsville (CA)

(72) Inventors: Ronald Chappell, Stittsville (CA); Stephen Dane Carey, LaVergne, TN (US)

(73) Assignee: T.A. Morrison & Co. Inc., Stittsville, Ontario (CA)

( * ) Notice: Subject to any disclaimer, the term of this patent is extended or adjusted under 35 U.S.C. 154(b) by 109 days.

(21) Appl. No.: 14/525,797

(22) Filed: Oct. 28, 2014

(65) Prior Publication Data

US 2016/0116184 A1 Apr. 28, 2016

(51) Int. Cl.
*F24F 13/14* (2006.01)
*F24F 13/15* (2006.01)

(52) U.S. Cl.
CPC ..... *F24F 13/1406* (2013.01); *F24F 13/15* (2013.01)

(58) Field of Classification Search
CPC ..... F24F 13/14
USPC ..... 454/335, 369, 333
See application file for complete search history.

(56) References Cited

U.S. PATENT DOCUMENTS 197,583 A * 11/1877 Allen ..... E06B 7/084 454/224
3,275,031 A 9/1966 Alyea et al.
3,447,443 A * 6/1969 Silvey ..... F24F 13/08 137/601.09
3,464,341 A * 9/1969 Dobrin ..... F24F 13/1413 454/336
3,476,042 A 11/1969 Carney, Jr. et al.
3,771,559 A 11/1973 Alley
4,077,432 A * 3/1978 Herr ..... F16K 1/165 137/246.22
4,184,288 A * 1/1980 Magill ..... A62C 2/14 137/601.09
4,185,657 A * 1/1980 McCabe ..... A62C 2/14 137/601.09
4,256,143 A * 3/1981 Magill ..... F24F 13/15 137/601.06
4,294,165 A * 10/1981 Bergdahl ..... A62C 2/08 137/253
4,294,283 A 10/1981 Scharres
4,436,136 A * 3/1984 Downey, Jr. ..... E06B 3/485 160/232
4,610,197 A * 9/1986 Van Becelaere ..... F23L 13/08 137/601.09
4,643,081 A * 2/1987 Vicinanza ..... E06B 7/086 137/601.05

(Continued)

*Primary Examiner* — Steven B McAllister
*Assistant Examiner* — Samantha Probst
(74) *Attorney, Agent, or Firm* — Sughrue Mion, PLLC

(57) ABSTRACT

A damper comprises a generally rectangular frame extending between opposed open faces and defining an airflow region. One or more damper blades comprises a substantially air-impermeable vane pivotally mounted between the sides of the frame and pivotable between an open position and a closed position. In the closed position an edge of the adjacent blade abuts a blade stop surface formed along each end, such that in the closed position one edge of the blade adjacent to each end of the frame extends into a recess and abuts the blade stop surface, to prevent air from flowing between the blade and the end of the frame. In the preferred embodiments the blade stop surfaces are integrally formed in each end panel.

13 Claims, 7 Drawing Sheets

(56) References Cited

U.S. PATENT DOCUMENTS 5,238,453 A * 8/1993 Heil ..... F24F 13/15 137/601.09
5,425,673 A * 6/1995 Mahlanen ..... A62C 2/14 137/601.09
5,515,902 A * 5/1996 Hoffman ..... E06B 9/165 160/235
5,580,307 A 12/1996 Arosio et al.
5,728,001 A * 3/1998 Attridge, Jr. ..... A62C 2/24 137/79
5,730,653 A * 3/1998 Van Becelaere ..... A62C 2/14 454/237
5,842,919 A * 12/1998 Lyons ..... F24F 13/15 137/601.11
5,941,021 A * 8/1999 Valls, Jr. ..... E06B 7/086 160/236
6,250,326 B1 * 6/2001 Kimball ..... A62C 2/242 126/287.5
6,263,632 B1 * 7/2001 Cadorette ..... E06B 7/086 403/331
8,036,778 B2 * 10/2011 Masuda ..... F24F 11/0034 165/208
8,500,528 B2 * 8/2013 Leonhard ..... F24F 13/15 454/325
9,650,786 B2 * 5/2017 Weaver ..... E04B 7/163
2001/0055947 A1 * 12/2001 McCabe ..... A62C 2/14 454/369
2002/0175305 A1 * 11/2002 McCabe ..... A62C 2/14 251/129.12
2004/0121722 A1 * 6/2004 Heil ..... F16K 17/386 454/369
2008/0051024 A1 * 2/2008 Caliendo ..... A62C 2/14 454/369
2011/0034120 A1 * 2/2011 Jaiyeola ..... F24F 11/006 454/335
2011/0053487 A1 * 3/2011 Casey ..... F24F 13/082 454/258
2014/0008561 A1 * 1/2014 Enke ..... F24F 13/14 251/306
2014/0273806 A1 * 9/2014 Frayer, III ..... B60K 11/085 454/335

* cited by examiner

Fig. 1
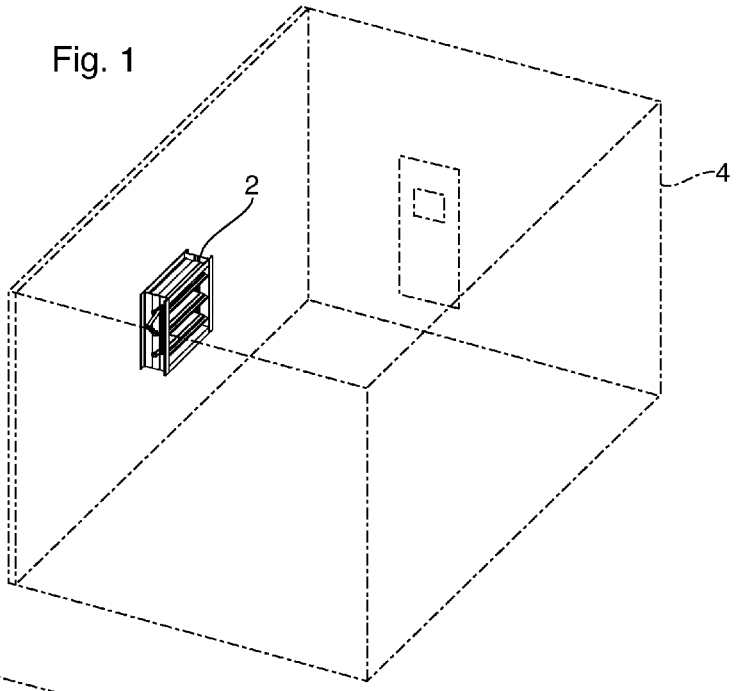
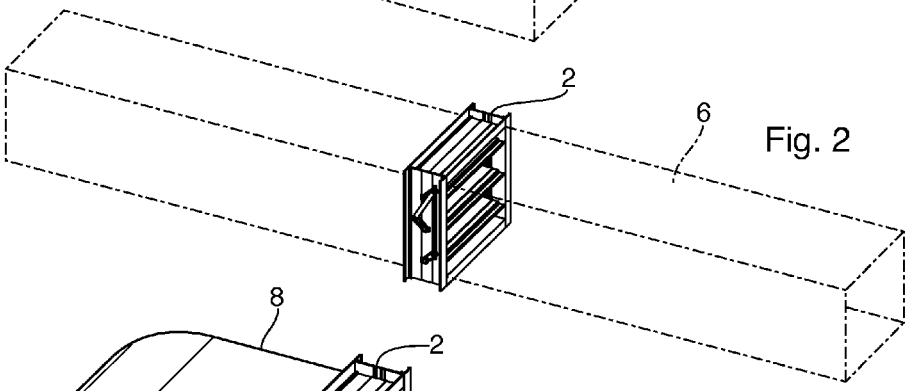
Fig. 2
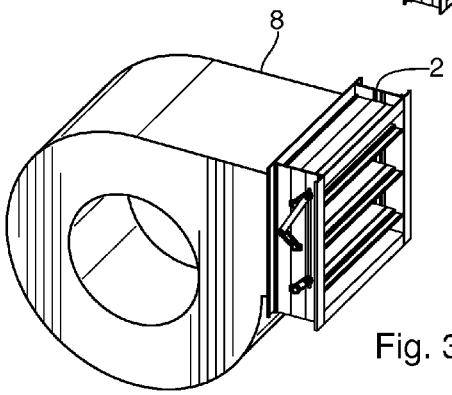
Fig. 3

DAMPER WITH INTEGRATED BLADE STOP

FIELD OF THE INVENTION

This invention relates to airflow dampers. In particular, this invention relates to dampers having one or more damper blades for closing off an airflow channel.

BACKGROUND OF THE INVENTION

Dampers are widely used in various industrial and commercial heating, ventilating and air conditioning (HVAC) systems. Single and multiple-blade dampers in particular are used to control airflow rates in a premises, prevent backflow and restrict smoke dispersion in fire safety applications, amongst other uses.

These dampers typically comprise an outer frame sized to either fit into a specified opening or to cover a specific opening, in various environments. For example, FIG. 1 illustrates a damper mounted to or on the wall of a plenum or HVAC unit 4; FIG. 2 illustrates a damper mounted to a duct 6 or in series with a duct 6; and FIG. 3 illustrates a damper mounted to the outlet of a blower 8. In each of these environments the damper controls airflow because the damper blades are movable from an open position in which air is permitted to flow through the airflow region bounded by the interior of the damper frame, and a closed position blocking the flow of air through the damper.

In many applications it is advantageous to securely close the damper blades so as to provide a substantially air-tight seal, for example in insulated dampers to prevent loss of heat and in backflow dampers to prevent potentially noxious gases from flowing into a premises or other habitable space. Conventional dampers thus provide damper stops extending into the interior airflow area in the path of the movement of the outer damper blades. This stops the damper blades at precisely the closed position and provides a surface against which the outer damper blades abut in order to inhibit airflow between the closed damper blades and the frame.

It is also important that the frame of a damper be structurally sound so as to retain its shape with fairly precise tolerances, otherwise leakage of air through the damper could occur. In the applications described above this is more than a mere inefficiency, and can result in loss of temperature control within a premises, or hazardous levels of noxious gases. The frame is thus constructed so to have structural integrity independent of the structure in which it is located, to prevent deformation that might cause leaks. Thus, in a prior art multiple-blade damper, as shown in FIG. 4, the frame is constructed from a fairly thick gauge of metal and is provided with 90 degree flanges which impart transverses rigidity to the sides and ends of the frame.

In such conventional dampers, blade stops are formed as separate pieces, typically extrusions, and affixed to the interior of the frame at the blade stop position by, for example, spot welding or fasteners. However, since the volume and flow rate of air flowing through the damper is in part determined by the area bounded by the interior of the frame, any structure extending into this area impedes airflow, not only by reducing the effective area within the frame but also by producing eddies and currents around the impinging structure that disrupt a laminar airflow pattern and cause additional resistance to the flow of air through the damper.

It would accordingly be advantageous to provide a single or multiple-blade damper comprising blade stops which do not impinge into the airflow area within the frame. It would further be advantageous to provide a damper comprising blade stops which assist in imparting structural integrity to the frame.

It will be appreciated that such dampers can be mounted into a structure or onto a structure for the selective control of airflow. References in the description to a damper mounted to a structure include all methods and means of fixing, securing and/or mounting a damper into a structure or onto a structure, and the invention is not in any way limited by the manner in which the damper is mounted to the structure.

BRIEF DESCRIPTION OF THE DRAWINGS

In drawings which illustrate by way of example only a preferred embodiment of the invention, FIG. 1 is a perspective view of a multiple-blade damper mounted to the wall of a plenum or HVAC unit.

FIG. 2 is a perspective view of a multiple-blade damper mounted to a duct.

FIG. 3 is a perspective view of a multiple-blade damper mounted to the outlet of a blower.

DETAILED DESCRIPTION OF THE INVENTION

Figure 4:
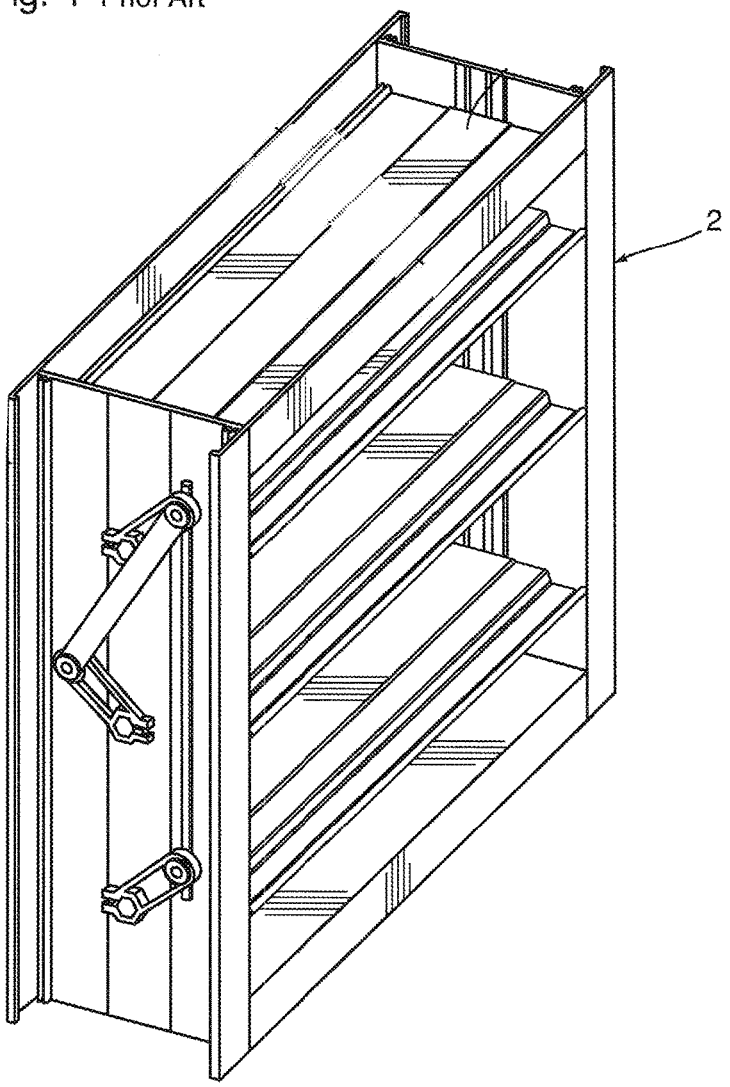
Fig. 4 Prior Art
FIG. 4 is a perspective view of a conventional multiple-blade damper.

The invention provides blade stops formed in the end surfaces of the frame, against which the outer blades abut in the closed position. Thus, in a damper 20 according to the invention the airflow region extends throughout the entire interior area of the damper frame, unimpeded by blade stops impinging into the path of the flowing air. This not only increases the effective cross-sectional area through which air can flow, but also avoids the creation of eddies and currents that create additional impediments to the free flow of air through the damper. A blade stop projecting into the airflow region in a conventional multi-blade damper 2 acts like a knife edge orifice and increases the pressure drop through the damper 2. Removing this structure from the airflow region allows the airflow to move toward becoming laminar, and thus to prevent the loss of some of the airstream energy before egressing into an open space.

Moreover, a blade stop structure according to the invention imparts additional rigidity to the damper frame, by providing structures extending transversely from planar end panels along the length of the ends, which resists deformation of the end panels and (depending upon the application) potentially permits the use of a lighter gauge of frame panel without sacrificing the structural integrity of the frame.

In some situations (for example where there is a duct upstream only or a plenum upstream only) a damper according to the invention may save fan input energy when replacing a conventional damper having blade stops projecting into the air stream. The fan may be able to run at a lower speed while producing the same airflow, thereby reducing the fan's energy requirements. This effect may be most pronounced in a damper having a frame width between 7" and 12", as compared to a damper having blade stops impeding the airstream, and particularly so in the upper end of this size range.

The invention thus provides a damper comprising a generally rectangular frame comprising side panels adjoining opposed ends, each end comprising an end panel extending between opposed open faces of the frame, the faces comprising an air inlet and an air outlet, the frame having an interior defining an airflow region extending between the open faces and bounded by the end panels and the side panels, and an exterior defined by outer limits of opposed flanges projecting outwardly generally parallel to planes containing the open faces, an extension zone being defined at each end between the opposed flanges, at least one blade comprising a substantially air-impermeable vane having a leading edge and a trailing edge, pivotally mounted between the side panels of the frame so as to pivot between an open position in which the blade permits a flow of air through the airflow region and a closed position in which an edge of one of the at least one blade adjacent to each end abuts a blade stop surface formed along the respective end, to thereby prevent a flow of air between the blade and the blade stop surface, the blade stop surfaces each projecting into the respective extension zone at a position corresponding to the closed position of the at least one blade to form a recess in a region of the end panel permitting the at least one blade to abut the respective blade stop surface to thereby prevent air from flowing between said blade and its associated end of the frame, and an actuator for pivoting the at least one blade between the open and closed positions.

Figure 5:
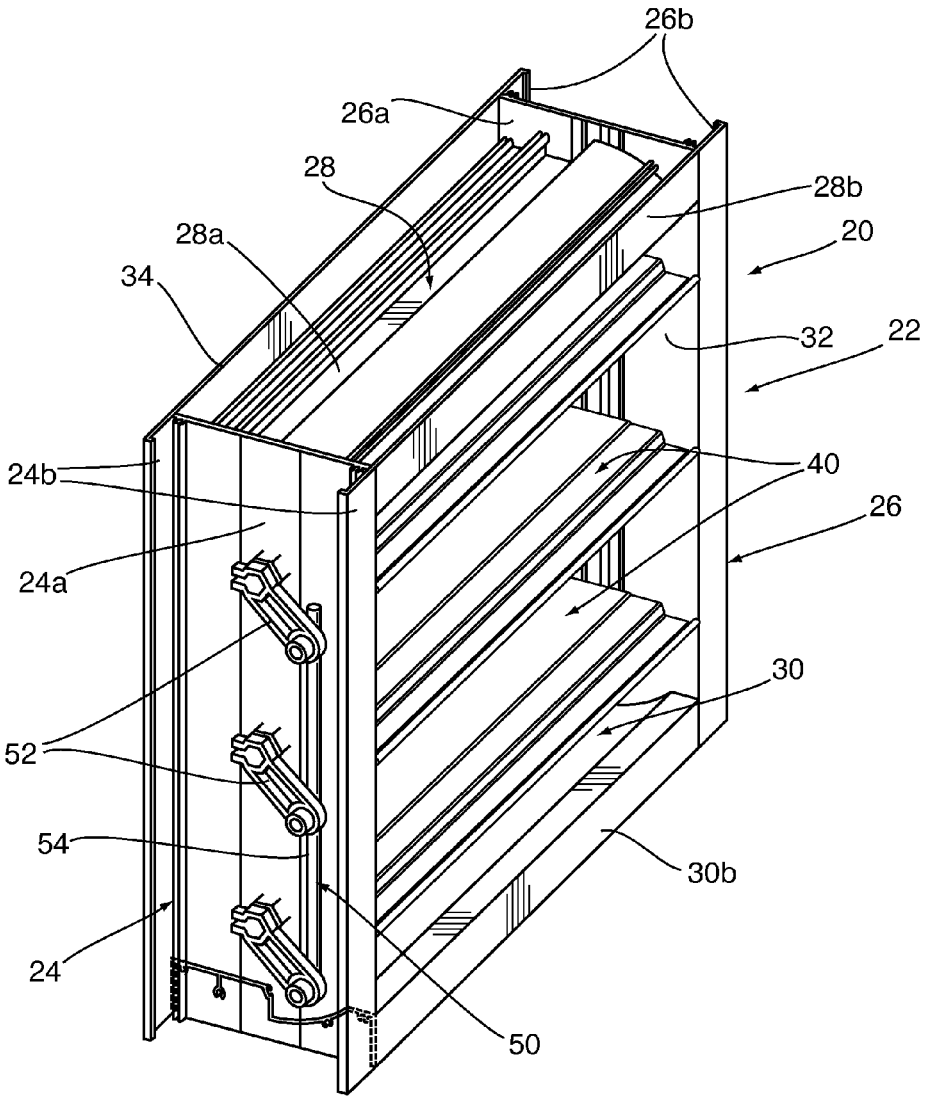
FIG. 5 is a perspective view of a multiple-blade damper according to the invention.

A damper 20 according to the invention is illustrated in FIG. 5, by way of example only. The damper 20 may be mounted in many different environments, for example to the wall of a plenum or HVAC unit 4, to a duct 6 or to the outlet of a blower 8 as indicated above, and the invention is not limited to any specific environment or application. Also, while the embodiment of the damper illustrated in FIGS. 5-7 has three blades, the invention is advantageously implemented in any damper 20 having at least one blade, regardless of the size, configuration or number of blades.

The damper 20 illustrated comprises a generally rectangular frame 22. The frame 22 comprises opposed sides 24, 26. Side 24 comprises a side panel 24*a* and opposed flanges 24*b* projecting outwardly, generally in a plane containing the respective front and rear faces 32, 34 of the damper 20; and side 26 similarly comprises a side panel 26*a* opposed flanges 26*b* projecting outwardly generally in a plane containing the respective front and rear faces 32, 34.

The sides 24, 26 are affixed to opposed ends 28, 30 comprising flanges 28*b*, 34*b*, and having a configuration which comprises an integrated blade stop surface as described in detail below. The sides 24, 26 may be joined to the ends 28, 30 of the damper 20 by welding, fasteners or any other suitable securing means.

The components of the frame 22 are formed from a suitable gauge of metal, preferably 0.05" to 0.25" (1.27 mm to 6.25 mm) aluminium or steel as is conventional, to provide a rigid frame that is not subject to substantial deformation when the damper 20 is in use.

The interior of the frame 22 thus defines an airflow region extending between the front and rear faces 32, 34. The airflow region is bounded by the side panels 24, 26 and the end panels 28, 30, and thus has a cross-section defined by the open area of the faces 32, 34 and a depth defined by the spacing between the faces 32, 34.

The frame 22 further defines an exterior, bounded by the outer limits of the flanges 24*b*, 26*b*, 28*b* and 30*b*. An extension zone 28', 30' is defined at each respective end 28, 30. One extension zone 28' is defined between the opposed flanges 28*b* and surface 28*a*, and extends through the depth of the flanges 28*b*. Another extension zone 30' is defined by the end 30 between the opposed flanges 30*b*, and extends through the depth of the flanges 30*b*. These extension zones provide a space for the respective integration of blade stops 60, 70 into each of the ends 28, 30, as described below.

Figure 6A:
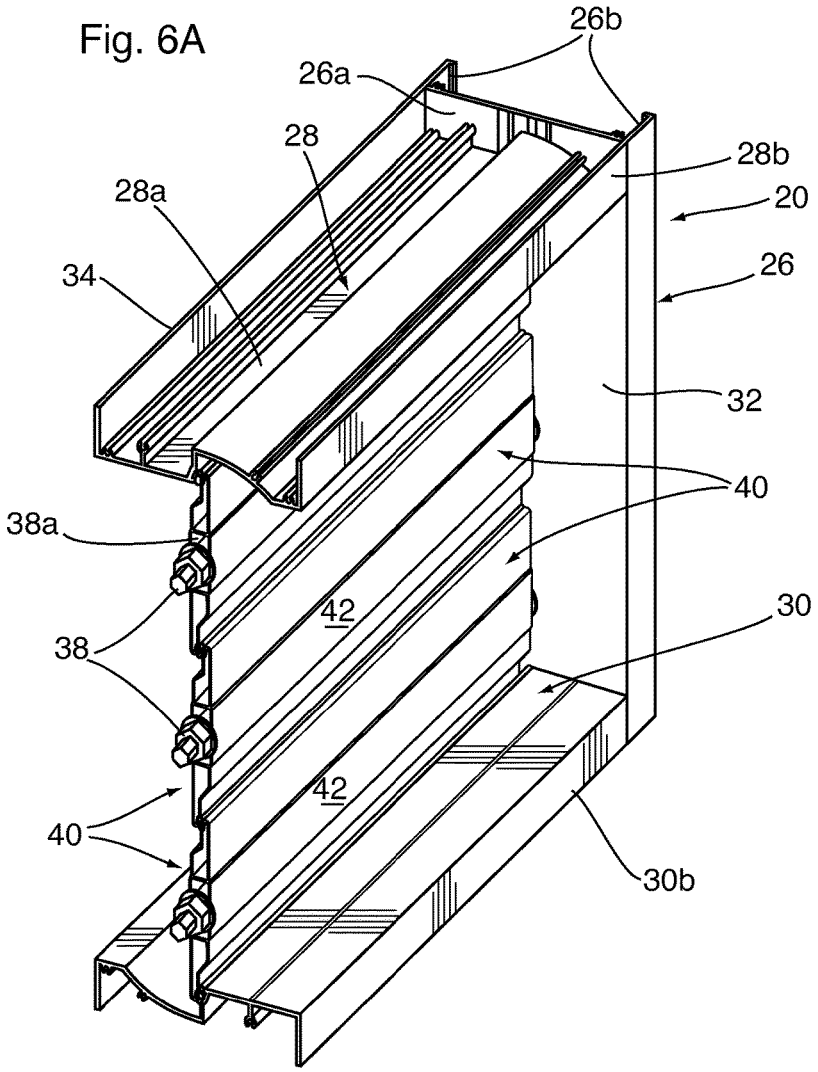
FIG. 6A is a partly cutaway perspective view of the damper of FIG. 5 with the vanes in the closed position.
Figure 6B:
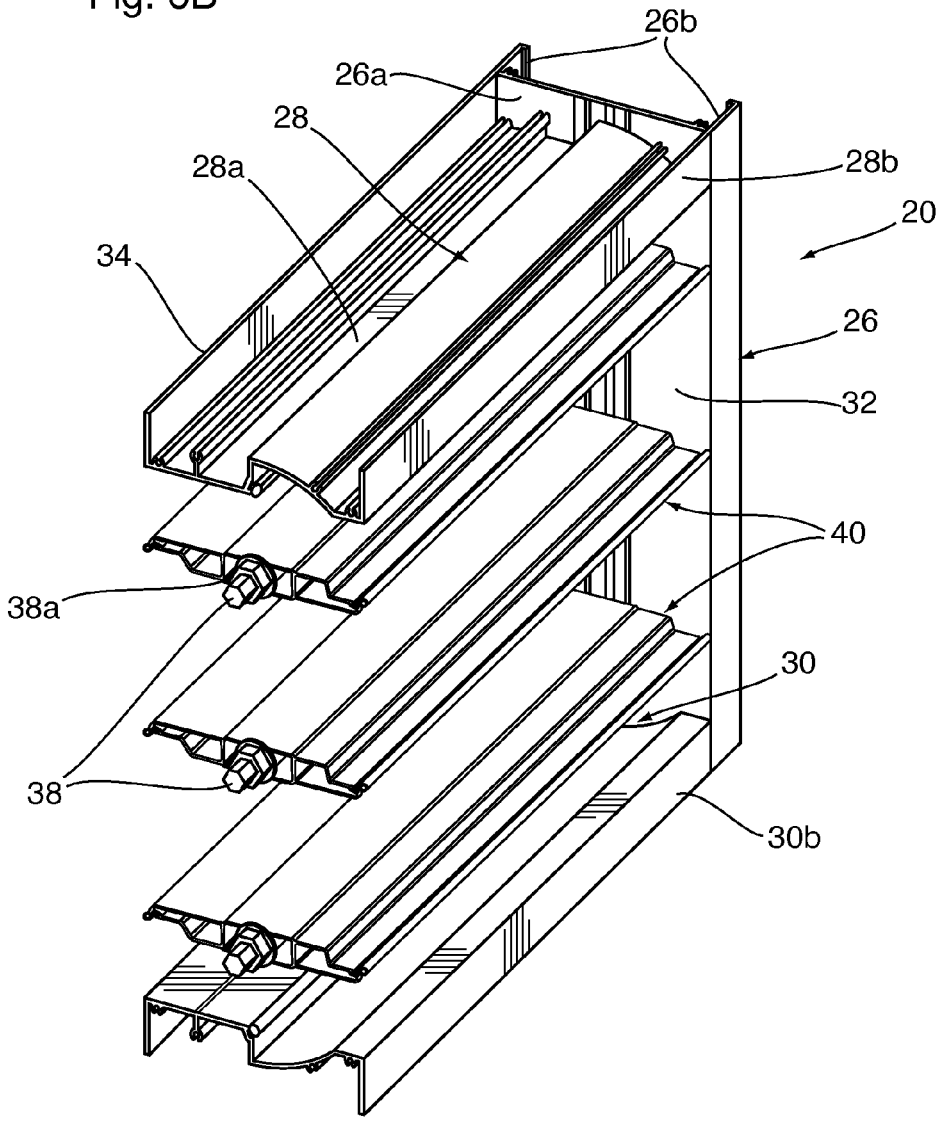
FIG. 6B is a partly cutaway perspective view of the damper of FIG. 5 with the vanes in the open position.

The frame 22 supports plurality of blades 40. As best seen in FIGS. 6A and 6B, each blade 40 comprises a substantially air-impermeable vane 42 comprising a leading edge 40', which moves in an arcuate path toward the front face 32 as the damper 20 is opened, and a trailing edge 40", which moves in an arcuate path toward the rear face 34 as the damper 20 is opened. The blades 40 are each pivotally mounted between the sides 24, 26 of the frame 22. Each blade 40 is preferably provided with a pivot rod 38 having longitudinal flat surfaces (for example, hexagonal in cross-section as in the embodiment illustrated in FIGS. 5 and 6) which is housed in rotationally locked relation within a channel 38*a* through the blade 40 so that the blade 40 rotates with the rod 38. The ends of the rods 38 extend beyond the ends of the blade 40 and are rotatably mounted through the sides 24, 26, optionally through bearings (not shown) affixed in the appropriate positions within the sides 24, 26.

An actuating mechanism 50 is provided for pivoting the multiple blades 40 simultaneously between the open and closed positions, in the embodiment shown comprising link arms 52 each having one end rotationally fixed to an end of a pivot rod 38 and having its other end pivotally connected to a common actuating bar 54. Thus, when the actuating bar 54 is moved the link arms 52 pivot in unison to rotate rods 38 and, in turn, move the blades 40 toward the open or closed position. It will be appreciated that other actuating mechanisms for dampers of this type are known, and the blades could alternatively be pivoted individually by independent actuators. The invention is not intended to be limited to any particular manner of mounting the blades 40 in the damper 20 or of opening and closing the damper 20.

The blades 40 thus pivot between an open position in which the blade permits a flow of air through the airflow region and a closed position wherein each edge of each of the plurality of blades 40 abuts either an edge of an adjacent blade 40 or the blade stop surface provided by one of the ends 28 or 30, forming a seal that closes the airflow region and prevents the flow of air through the damper 20. It can thus be seen that the blade stop surfaces 68, 78 are in general alignment with the pivot point of each blade 40, so that adjacent edges of adjacent blades contact each other as the outermost edges of the blades 40 respectively contact the blade stop surfaces 68, 78.

Figure 7:
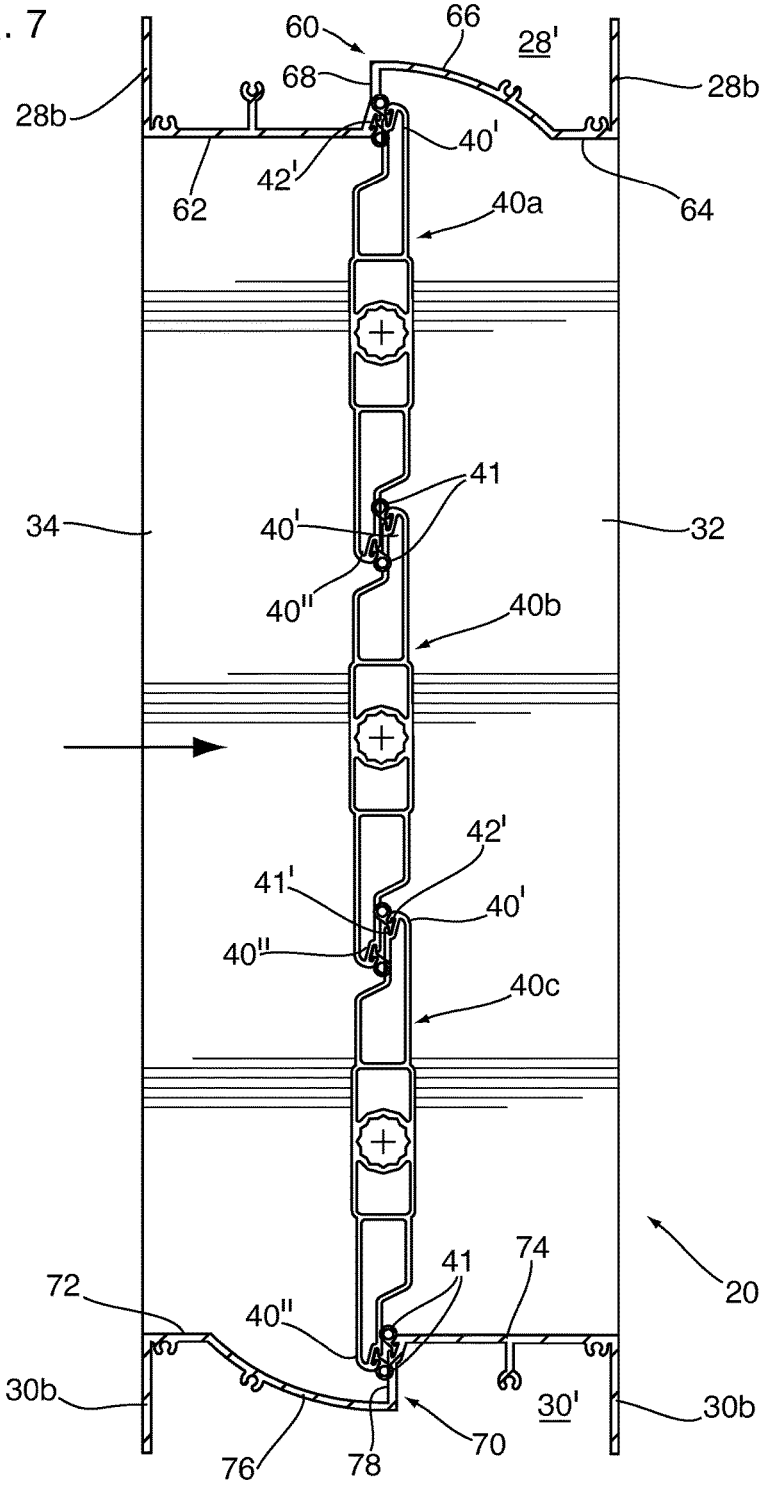
FIG. 7 is a cross-sectional side elevation of the multiple-blade damper of FIG. 5 wherein the blades rotate in the same direction.

Each blade 40 preferably comprises at least one seal for closing the airflow region. In the embodiment illustrated each of the leading and trailing edges 40', 40" of each blade is provided with a seal 41, for example a compressible bulb-type seal as is commonly used in weather-stripping applications formed from silicone or a rubber elastomer, mounted to a channel or flute 42' extending along the length of the vane 42 near each edge 40' and 40". The flute 42' is preferably disposed at a slight angle relative to the vane 42, so that as the edge of a blade 40 closes the seal 41 is depressed between either the blade 40 and the adjacent blade 40 or between either the blade 40 and a blade stop surface 60 or 70 as described below. A similar seal 41 is provided along each of the blade stop surfaces 60, 70. The seals 41 are preferably positioned such that when the blade 40 is in the closed position a dead air space 41' is formed between adjacent seals, as best seen in FIG. 7. Each point of contact between a blade 40 and an adjacent blade 40 or blade stop surface is thus sealed against air flowing around the edges of the blade 40, blocking the passage of air and resisting heat transfer caused by a thermal differential between the front and rear faces of the damper 20.

For example, in the damper 20 illustrated in FIG. 7, the three blades 40*a*, 40*b* and 40*c* are illustrated in the closed position. The leading edge 40' of blade 40*a* abuts the blade stop surface 68 formed in the end 28, and the trailing edge 40" of blade 40*a* overlaps and abuts the leading edge 40' of the blade 40*b*. The trailing edge 40" of the blade 40*b* overlaps and abuts the leading edge 40' of blade 40*c*, and the trailing edge 40" of the blade 40*c* abuts the blade stop surface 78 formed in the end 30.

The end panels 28, 30 extend fully between the open front and rear faces 32, 34. The end panels 28, 30 each respectively provide a blade stop 60, 70, preferably formed integrally into the respective end panel 28, 30 of the frame 22. The blade stops 60, 70 each comprise a portion of the respective end panel 28, 30 that projects into the extension zone at the closed position of the blades 40*a*, 40*c*, as best seen in FIG. 7.

The end panel 28 comprises a rear panel 62 coplanar with a front panel 64 respectively defining the end of the rear face 34 and front face 32 of the damper 20 (and thus the end of the airflow region); a curved portion 66 extending into the extension zone 28' and generally congruent with the arcuate path of travel of the leading edge 40' of the adjacent blade 40*a*; and a blade stop surface 68 extending into the extension zone 28' and meeting the outer limit of the curved portion 66, together forming a recess projecting into the extension zone 28' in a region corresponding to a path of travel of the leading edge 40' of the blade 40*a* which abuts the blade stop 60.

Similarly, the end panel 30 comprises a rear panel 72 coplanar with a front panel 74 respectively defining the other end of the rear face 34 and front face 32 of the damper 20 (and thus the other end of the airflow region); a curved portion 76 extending into the extension zone 30' and generally congruent with the arcuate path of travel of the trailing edge 40" of the adjacent blade 40*c*; and a blade stop surface 78 extending into the extension zone 30' and meeting the outer limit of the curved portion 76, forming a recess projecting into the extension zone 30' in a region corresponding to a path of travel of the trailing edge 40' of the blade 40*c* which abuts the blade stop 70.

Accordingly, in the closed position one edge of the outermost blades 40*a* and 40*c* (i.e. the blades adjacent to each end of the frame 22) extends into the recess formed by the respective blade stop 60 or 70, to thereby prevent air from flowing between said blade 40 and the associated end of the frame 22, while in the open position the airflow region is defined fully between the end panels 28, 30 without any obstacles or occlusions as in the prior art.

Figure 8:
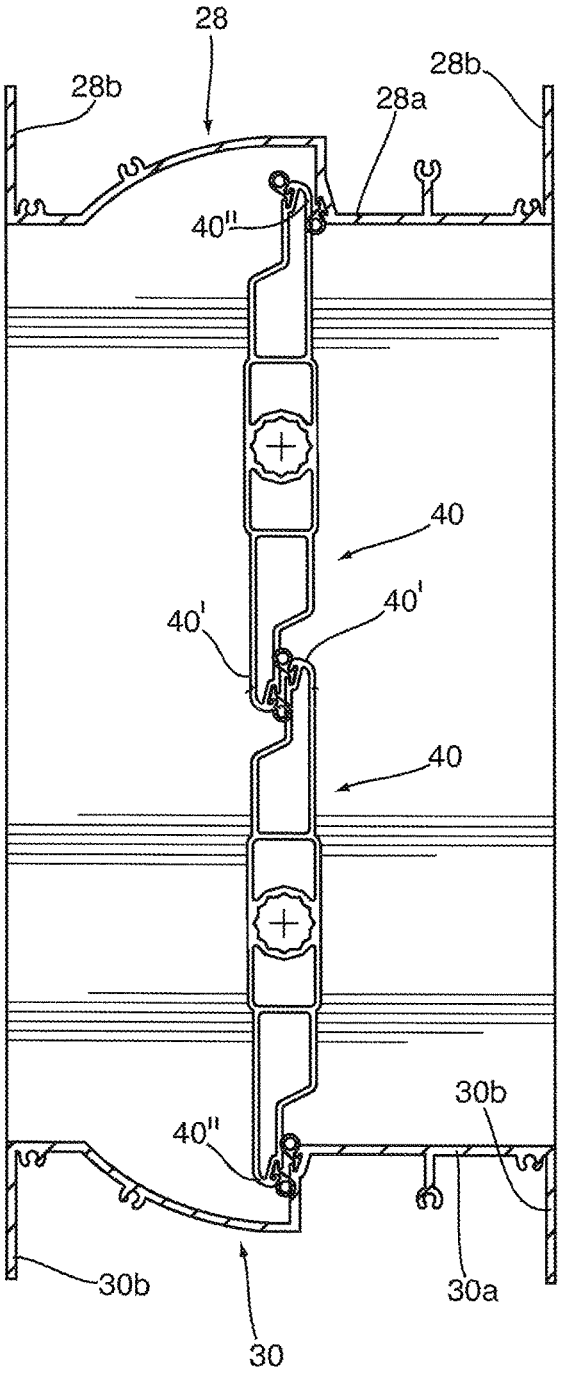
FIG. 8 is a cross-sectional side elevation of a further multiple-blade damper according to the invention having wherein some blades rotate in opposite directions.

In the embodiment illustrated in FIGS. 5 to 7 the blade stops 60 and 70 are disposed at different positions in the ends 28, 30 and oriented opposite to one another, because there is an odd number of blades 40 (three in the embodiment shown) and all blades 40 rotate in the same direction. Thus, a recess into the extension zone 28' in front of the blades 40 is required in order to accommodate the path of travel of the leading edge 40' of the blade 40*a*, while a recess into the extension zone 30' behind the blades 40 is required in order to accommodate the path of travel of the trailing edge 40" of the blade 40*c*. In other embodiments, for example the 2-blade embodiment illustrated in FIG. 8 in which the blades 40 counter-rotate, the blade stops 60 and 70 are respectively disposed in the ends 28, 30 at generally the same position (behind the two blades 40) and in the same orientation, in order to accommodate the path of travel of the trailing edges 40" of both blades 40.

Various embodiments of the present invention having been thus described in detail by way of example, it will be apparent to those skilled in the art that variations and modifications may be made without departing from the invention. The invention includes all such variations and modifications as fall within the scope of the appended claims.

The invention claimed is:

1. A damper comprising a generally rectangular frame comprising spaced apart side panels adjoining opposed ends of the frame, each end comprising an end panel extending between opposed open faces of the frame, the faces comprising an air inlet and an air outlet, the frame having an interior defining an airflow region extending between the open faces and bounded by the end panels and the side panels, and an exterior defined by outer limits of opposed flanges projecting outwardly generally parallel to planes containing the open faces, an extension zone extending outside of the airflow region between the opposed flanges at each end from the airflow region to the outer limits of the opposed flanges, each end panel having a front panel and a rear panel defining a least a portion of the airflow region and a blade stop therebetween, the blade stop comprising a blade stop surface extending outwardly from one of the front panel and the rear panel and having a curved portion extending from the blade stop surface to the other of the front panel and the rear panel, at least one blade comprising a substantially air-impermeable vane having a leading edge and a trailing edge, pivotally mounted between the side panels of the frame so as to pivot between an open position in which the blade permits a flow of air through the airflow region and a closed position in which an edge of one of the at least one blade adjacent to each end abuts the blade stop surface formed along the respective end, to thereby prevent a flow of air between the blade and the blade stop surface, the blade stop surfaces each projecting outwardly into the respective extension zone at a position corresponding to the closed position of the at least one blade to form a recess in a region of the end panel permitting the at least one blade to abut the respective blade stop surface to thereby prevent air from flowing between said blade and its associated end of the frame, and an actuator for pivoting the at least one blade between the open and closed positions.

2. The damper of claim 1, wherein the at least one blade comprises a plurality of blades, wherein in the closed position adjacent edges of adjacent blades abut one another to prevent a flow of air between blades.

3. The damper of claim 2 wherein each blade in the plurality of blades rotates in the same direction.

4. The damper of claim 2 wherein the at least one blade rotates in a direction opposite to a direction of rotation of at least one other blade in the plurality of blades.

5. The damper of claim 2 wherein the blade stop surfaces are formed integrally with the respective end panels.

6. The damper of claim 1 wherein the curved portion is shaped generally complementary to a path of travel of the adjacent blade edge.

7. A damper comprising a generally rectangular frame comprising spaced apart side panels adjoining opposed ends of the frame, each end comprising an end panel extending between opposed open faces of the frame, the faces comprising an air inlet and an air outlet, the frame having an interior defining an airflow region extending between the open faces and bounded by the end panels and the side panels, and an exterior defined by outer limits of opposed flanges projecting outwardly generally parallel to planes containing the open faces, an extension zone exterior the airflow region between the opposed flanges at each end from the airflow region and separated from the airflow region by the end panel, each end panel having a front panel, a rear panel and a blade stop therebetween, the blade stop comprising a blade stop surface extending outwardly from one of the front panel and the rear panel and having a curved portion extending from the blade stop surface to the other of the front panel and the rear panel;

at least one blade comprising a substantially air-impermeable vane having a leading edge and a trailing edge, the vane being pivotally mounted between an interior portion of the side panels of the frame so as to pivot between an open position in which the vane permits a flow of air through the airflow region and a closed position in which one of the leading edge and the trailing edge of one of the vane adjacent to each end abuts the blade stop surface extending outwardly from airflow region and into the extension zone of each respective end, to thereby prevent a flow of air between the vane and the blade stop surface, the blade stop surfaces each projecting into the respective extension zone at a position corresponding to the closed position of the at least one blade to form a recess in a region of the end panel permitting the vane to abut the respective blade stop surface to thereby prevent air from flowing between said vane and its associated end of the frame, and an actuator for pivoting the at least one blade between the open and closed positions.

8. The damper of claim 7, wherein the at least one blade comprises a plurality of blades, wherein in the closed position adjacent edges of adjacent vanes abut one another to prevent a flow of air between blades.

9. The damper of claim 8 wherein the at least one blade rotates in a direction opposite to a direction of rotation of at least one other blade in the plurality of blades.

10. The damper of claim 8 wherein edges of the vanes comprise a seal.

11. The damper of claim 10 wherein in the closed position the seals on overlapping vane edges are spaced apart.

12. The damper of claim 8 wherein the blade stop surfaces are formed integrally with the respective end panels.

13. The damper of claim 7 wherein the curved portion is shaped generally complementary to a path of travel of the adjacent blade edge.

* * * * *